US010716967B2

(12) United States Patent
Xing

(10) Patent No.: US 10,716,967 B2
(45) Date of Patent: Jul. 21, 2020

(54) TRANSMISSION SYSTEM FOR TREADMILL

(71) Applicant: OMA METAL INDUSTRIAL CO., LTD., Foshan (CN)

(72) Inventor: Kaibin Xing, Foshan (CN)

(73) Assignee: OMA METAL INDUSTRIAL CO., LTD. (CN)

( * ) Notice: Subject to any disclaimer, the term of this patent is extended or adjusted under 35 U.S.C. 154(b) by 100 days.

(21) Appl. No.: 16/145,424

(22) Filed: Sep. 28, 2018

(65) Prior Publication Data

US 2020/0030659 A1 Jan. 30, 2020

(30) Foreign Application Priority Data

Jul. 26, 2018 (CN) ..... 2018 1 0835859
Sep. 17, 2018 (CN) ..... 2018 1 1081512

(51) Int. Cl.
*A63B 22/02* (2006.01)
*A63B 23/04* (2006.01)
(Continued)

(52) U.S. Cl.
CPC ..... *A63B 22/0257* (2013.01); *A63B 23/04* (2013.01); *A63B 23/18* (2013.01); *A63B 21/00192* (2013.01); *A63B 21/15* (2013.01)

(58) Field of Classification Search
CPC ..... A63B 21/00058; A63B 21/00069; A63B 21/00072; A63B 21/00192; A63B 21/005;
(Continued)

(56) References Cited

U.S. PATENT DOCUMENTS 5,267,925 A * 12/1993 Boyd ..... A63B 21/0056 188/77 R
5,382,207 A * 1/1995 Skowronski ..... A63B 22/0023 198/807
(Continued)

FOREIGN PATENT DOCUMENTS

CN 2229820 Y 6/1996
CN 2539547 Y 3/2003
(Continued)

OTHER PUBLICATIONS

First Office Action dated Oct. 9, 2019 for Chinese Application No. 201810835859.2.
(Continued)

*Primary Examiner* — Gary D Urbiel Goldner
(74) *Attorney, Agent, or Firm* — Akerman LLP

(57) ABSTRACT

A transmission system for a treadmill is provided, which includes a primary transmission wheel, a secondary transmission wheel, a metal disk and a magnetic assembly; wherein the primary transmission wheel is rotated coaxially with a chain wheel of the treadmill; the secondary transmission wheel is connected with the primary transmission wheel through a first belt; the metal disk is connected with the secondary transmission wheel through a second belt; the magnetic assembly is rotatably connected to a frame of the treadmill, and the magnetic assembly is moveable close to or away from a center of the metal disk to provide a resistance to the metal disk; and the magnetic assembly is connected with a handle of the treadmill. Through the transmission system for the treadmill of the present application, the resistance to the movement may be changed to meet the user's demand for different exercise intensity.

14 Claims, 5 Drawing Sheets

(51) Int. Cl.
*A63B 23/18* (2006.01)
*A63B 21/00* (2006.01)

(58) Field of Classification Search
CPC ..... A63B 21/0051; A63B 21/0052; A63B 21/0056; A63B 21/0057; A63B 21/012; A63B 21/0125; A63B 21/15; A63B 21/151; A63B 21/152; A63B 21/154; A63B 21/156; A63B 21/159; A63B 21/22; A63B 21/225; A63B 21/4027; A63B 21/4033; A63B 21/4035; A63B 21/4041; A63B 21/4045; A63B 21/4047; A63B 21/4049; A63B 22/0046; A63B 22/02; A63B 22/0235; A63B 22/0242; A63B 22/025; A63B 22/0257; A63B 23/035; A63B 23/03516; A63B 23/04; A63B 23/0405; A63B 23/047; A63B 24/0087; A63B 69/0028; A63B 71/0054; A63B 2071/0063; A63B 2071/0072; A63B 2071/0081; A63B 2071/009; A63B 2208/0204; A63B 2209/00; A63B 2209/08
See application file for complete search history.

(56) References Cited

U.S. PATENT DOCUMENTS

| | | | | |
|---|---|---|---|---|
| 5,484,362 | A * | 1/1996 | Skowronski | A63B 22/0023 482/51 |
| 5,993,358 | A | 11/1999 | Gureghian et al. | |
| 6,833,644 | B1 | 12/2004 | Lee | |
| 7,381,158 | B2 * | 6/2008 | Girard | A63B 21/154 482/51 |
| 9,039,580 | B1 | 5/2015 | Bayerlein et al. | |
| 2003/0153436 | A1 * | 8/2003 | Ho | A63B 21/00178 482/63 |
| 2006/0046901 | A1 * | 3/2006 | Pan | A63B 21/00 482/51 |
| 2007/0037667 | A1 * | 2/2007 | Gordon | A63B 21/155 482/51 |
| 2014/0274576 | A1 * | 9/2014 | Beard | A63B 22/0235 482/54 |
| 2014/0274577 | A1 * | 9/2014 | Beard | A63B 21/157 482/54 |
| 2015/0080189 | A1 | 3/2015 | Villani | |
| 2015/0209610 | A1 * | 7/2015 | Dalebout | A63B 22/02 482/54 |
| 2016/0023039 | A1 * | 1/2016 | Cei | A63B 21/154 482/54 |
| 2016/0166877 | A1 * | 6/2016 | Cei | A63B 22/0285 482/54 |
| 2017/0182356 | A1 * | 6/2017 | Cei | A63B 22/0207 |
| 2018/0021617 | A1 * | 1/2018 | Krull | A63B 21/00069 482/128 |
| 2018/0036586 | A1 * | 2/2018 | Cristofori | A63B 22/0025 |
| 2018/0043206 | A1 | 2/2018 | Crist et al. | |
| 2018/0154204 | A1 * | 6/2018 | Bayerlein | A63B 22/0605 |
| 2018/0207468 | A1 * | 7/2018 | Golesh | A63B 21/0125 |
| 2019/0083838 | A1 * | 3/2019 | Lo | A63B 21/00069 |
| 2019/0083844 | A1 * | 3/2019 | Bayerlein | A63B 21/0125 |
| 2019/0168067 | A1 * | 6/2019 | Bates | A63B 22/0285 |

FOREIGN PATENT DOCUMENTS

| | | | |
|---|---|---|---|
| CN | 2614072 | Y | 5/2004 |
| CN | 202605603 | U | 12/2012 |
| CN | 103285554 | A | 9/2013 |
| CN | 203196260 | U | 9/2013 |
| CN | 203525221 | U | 4/2014 |
| CN | 205586429 | U | 9/2016 |
| CN | 206745827 | U | 12/2017 |
| CN | 207 342 100 | U | 5/2018 |
| GB | 2556907 | A | 6/2018 |
| WO | 2014/146130 | A2 | 9/2014 |

OTHER PUBLICATIONS

Search Report dated Sep. 24, 2019 for Chinese Application No. 201810835859.2.
European Search Report dated Jan. 10, 2019 issued in connection with corresponding European Patent Application No. 18 19 6307.
First Office Action dated Dec. 12, 2019 issued in connection with Chinese Application No. 201811081512.X.
Search Report dated Dec. 5, 2019 issued in connection with Chinese Application No. 201811081512.X.
Second Office Action dated Mar. 18, 2020 issued in connection with Chinese Application No. 201810835859.2.

* cited by examiner

TRANSMISSION SYSTEM FOR TREADMILL

CROSS REFERENCE TO RELATED APPLICATIONS

The present application claims the benefit of priority to Chinese patent application No. 201810835859.2, filed on Jul. 26, 2018, entitled "Transmission System for Treadmill" and Chinese patent application No. 201811081512.X, filed on Sep. 17, 2018, entitled "Transmission System for Treadmill", which are incorporated in the present application by reference in its entirety.

TECHNICAL FIELD

The present application relates to a field of fitness equipment, and more particularly to a transmission system for a treadmill.

BACKGROUND

With the continuous growth in people's living standards, health has became the most concerned issue in daily life.

The treadmill is a common fitness equipment used at the family and the gym, which is the simplest one of existing household fitness equipment and the best choice for the family.

However, operation modes of the existing treadmill is relatively simple, it is difficult to adjust exercise resistance, and cannot meet the user's demand for a different exercise intensity.

SUMMARY

A transmission system for the treadmill is provided according to embodiments of the present application, to solve at least one or more problems in the existing technology, or provide at least a advantageous selection.

In a first aspect, a transmission system for the treadmill is provided according to an embodiment of the present application, which includes: a primary transmission wheel, a secondary transmission wheel, a metal disk and a magnetic assembly; wherein the primary transmission wheel is rotated coaxially with a chain wheel of the treadmill; the secondary transmission wheel is connected with the primary transmission wheel through a first belt; the metal disk is connected with the secondary transmission wheel through a second belt; the magnetic assembly is rotatably connected to a frame of the treadmill, and the magnetic assembly is movably close to or away from a center of the metal disk to provide a resistance to the metal disk; and the magnetic assembly is connected to a handle of the treadmill, the handle is configured to control the magnetic assembly to rotate relative to the frame.

In an embodiment, the primary transmission wheel is coaxially connected with the chain wheel of the treadmill through a first rotating shaft; a second rotating shaft is provided on the secondary transmission wheel, and the secondary transmission wheel is rotatably connected with the frame through the second rotating shaft; and the first belt has a first provided around an outer ring of the primary transmission wheel, and a second end of the first belt is provided around an outer ring of the second rotating shaft.

In an embodiment, the second rotating shaft is connected with the secondary transmission wheel through a one-way bearing.

In an embodiment, the secondary transmission wheel is provided with an axle hole, the second rotating shaft passes through the axle hole, the axle hole has a first inner diameter and a first end of the axle hole has a second inner diameter, the second inner diameter is larger than the first inner diameter, the first end of the axle hole having the second inner diameter forms a first groove, and the one-way bearing is positioned into the first groove; and the second rotating shaft is provided passing through the one-way bearing and the axle hole.

In an embodiment, a first deep groove ball bearing is positioned in the first groove and is adjacent to the one-way bearing, a second end, opposite to the first end, of the axle hole has a third inner diameter, the third inner diameter is larger than the first inner diameter, the second end of the axle hole having the third inner diameter forms a second groove, and a second deep groove ball bearing is positioned into the second groove; and the second rotating shaft is provided passing through the first deep groove ball bearing, the one-way bearing, the axle hole and the second deep groove ball bearing.

In an embodiment, a third rotating shaft is provided on the metal disk, and the metal disk is rotatably connected with the frame through the third rotating shaft; and the second belt has a first end provided around the outer ring of the secondary transmission wheel, and a second end provided around the outer ring of the third rotating shaft.

In an embodiment, a connector is provided at the frame, and the magnetic assembly is rotatably connected with the connector.

In an embodiment, the magnetic assembly comprises a first connecting arm, and a second connecting arm opposite to the first connecting arm; and the first connecting arm and the second connecting arm are both pivoted to the connector; a gap is provided between the first connecting arm and the second connecting arm and the metal disk passes through the gap; and a first magnetic component is provided on the first connecting arm, a second magnetic component is provided on the second connecting arm.

In an embodiment, the first magnetic component is provided on a side, opposite to the second connecting arm, of the first connecting arm; and the second magnetic component is provided on a side, opposite to the first connecting arm, of the second connecting arm.

In an embodiment, the first magnetic component comprises a first magnetic element and a second magnetic element, the second magnetic component comprises a third magnetic element and a fourth magnetic element.

In an embodiment, the first magnetic element is disposed opposite to the third magnetic element, and the second magnetic element is disposed opposite to the fourth magnetic element.

In an embodiment, the first connecting arm is connected to the second connecting arm through a connecting board; a fixing part is provided on the first connecting arm and/or the second connecting arm, and the fixing part is fixed to a rope connected to the handle; and the handle is configured to control the rotation of the magnetic component relative to the frame through the rope.

In a second aspect, a treadmill is provided according to an embodiment of the present application, which includes the above transmission system for a treadmill.

The present application has the following advantages by adopting the above technical solutions: through the transmission system for the treadmill, the resistance to the movement may be changed to meet the user's demand for different exercise intensity.

The above summary is merely for the purpose of illustration and is not intended to be limited in any way. In addition to the aspects, embodiments and features described above, further aspects, embodiments, and features of the present application will be readily apparent from the following detailed description with reference to the accompanying drawings.

BRIEF DESCRIPTION OF THE DRAWINGS

In the drawings, the same reference numerals refer to the same or like parts or elements throughout several drawings, unless specified otherwise. These drawings are not necessarily drawn to scale. It is to be understood that these drawings only depict some embodiments according to the present application and should not be construed as limiting the scope of the present application.

DETAILED DESCRIPTION

In the following, only certain exemplary embodiments are briefly described. As will be appreciated by those skilled in the art, the described embodiments may be modified in various different ways without departing from the spirit or scope of the invention. Accordingly, the drawings and description are to be regarded as being illustrative in nature and not restrictive.

The transmission system for the treadmill of the present application will be described below with the reference to FIGS. 1 to 7.

Figure 1:
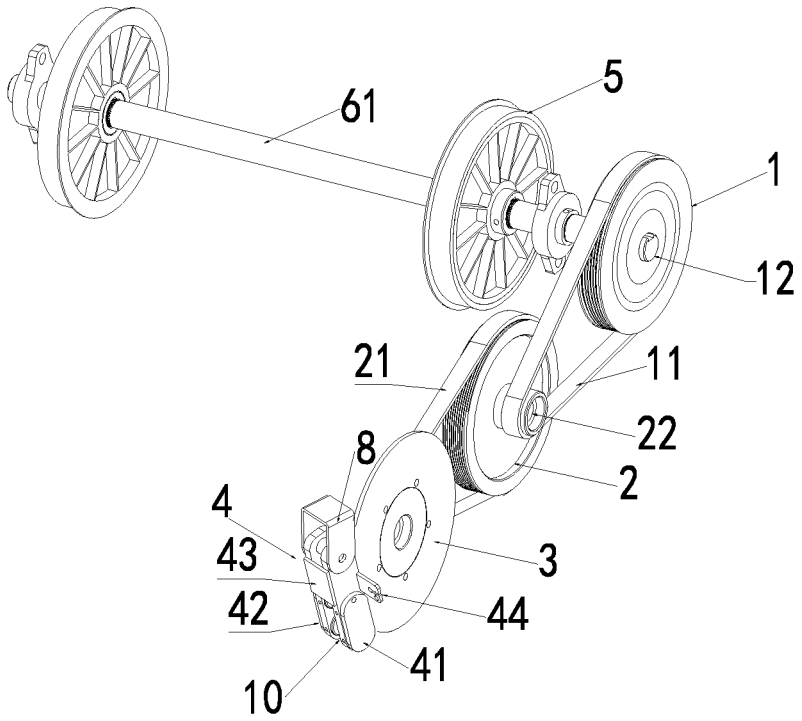
FIG. 1 is a perspective view of a transmission system for a treadmill according to an embodiment of the present application.

As shown in FIG. 1, in an embodiment, the transmission system for the treadmill of the present application includes a primary transmission wheel 1, a secondary transmission wheel 2, a metal disk 3 and a magnetic assembly 4.

The primary transmission wheel 1 is rotated coaxially with a chain wheel 5 of the treadmill. The chain wheel 5 will be rotated therewith, when the tread of the treadmill is driven by a motor, so that the primary transmission wheel 1 is driven to rotate.

Figure 2:
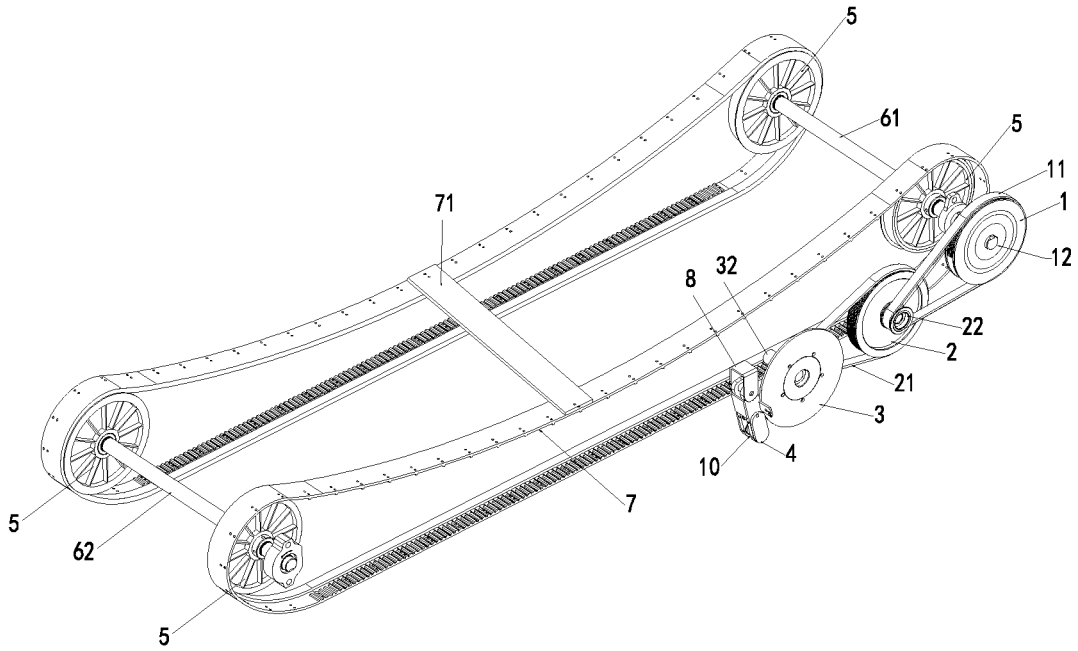
FIG. 2 is a perspective view of a transmission system and a tread for a treadmill according to an embodiment of the present application.

As shown in FIG. 2, a plurality of aluminum stripes 71 is mounted on a chain fixing band 7 to form the tread. After the motor is driven, the tread moves around the chain wheel 5, so that the chain wheel 5 is driven to rotate. In order to guarantee the two chain wheels 5 in front of the treadmill to rotate stably, a front roller 61 is provided between the two chain wheels 5 in the front to connect the two. In a similar way, a back roller 62 is provided between the two chain wheels 5 in the rear to connect the two.

Further, the secondary transmission wheel 2 is connected with the primary transmission wheel 1 through a first belt 11, and the metal disk 3 is connected with the secondary transmission wheel 2 through a second belt 21, thereby driving the secondary transmission wheel 2 to rotate by the first belt 11 while the primary transmission wheel 1 rotates, and driving the metal disk 3 to rotate by the secondary transmission wheel 2 through the second belt 21. Thus, multiple transmission is formed among the primary transmission wheel 1, the secondary transmission wheel 2 and metal disk 3, improving the ratio of transmission and increasing the rotational speed of the metal disk 3. Contrarily, when a small resistance is applied to the metal disk 3, a great limit may be transmitted to the chain wheel 5.

In the present invention, the belt is a general term of the parts or components that function as the transmission.

Figure 3:
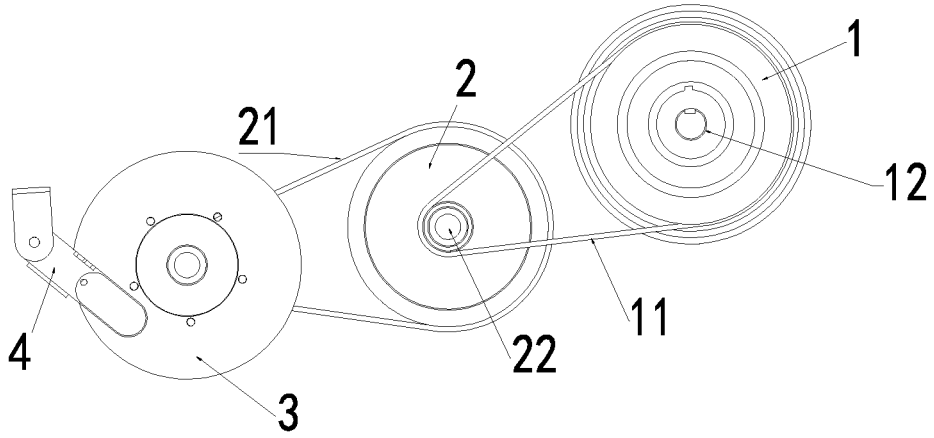
FIG. 3 is a side view of a transmission system for a treadmill according to an embodiment of the present application.

Further, the magnetic assembly 4 may be rotatably connected to a frame 8 (referring to FIG. 7) of the treadmill. In addition, as shown in FIG. 3, the magnetic assembly 4 may be movably close to a center of the metal disk 3 during the rotation thereof. The magnetic assembly 4 may produce a magnetic force to the metal disk 3, thereby hindering the rotation of the metal disk 3.

When the rotational speed of the metal disk 3 is reduced because of being hindered, the rotational speeds of the secondary transmission wheel 2 and the primary transmission wheel 1 are sequentially affected to be reduced. And then, the rotational speed of the chain wheel 5 is affected to be reduced by the primary transmission wheel 1. When the rotational speed of the chain wheel 5 is reduced, the resistance to the tread moving on the chain wheel 5 may be directly produced, so that a resistance to the movement is increased during the using of users.

Figure 4:
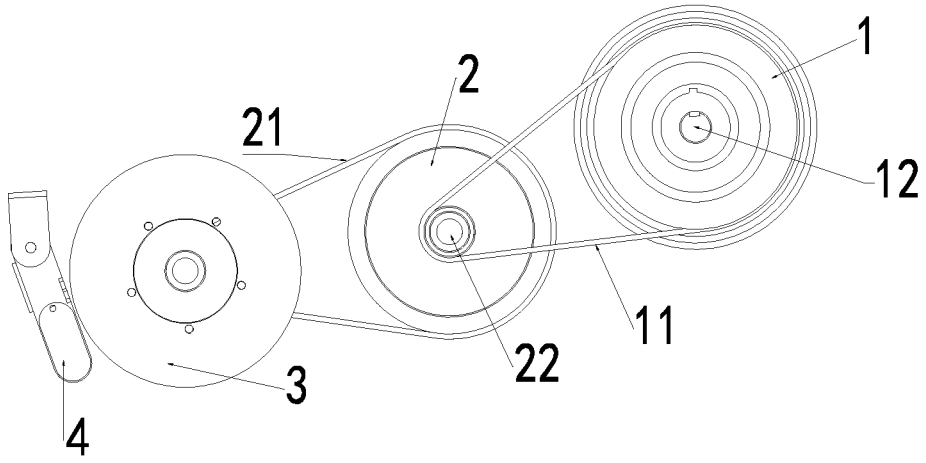
FIG. 4 is a side view of a transmission system for a treadmill according to another embodiment of the present application.

As shown in FIG. 4, the magnetic assembly 4 may also be movably away from the center of the metal disk 3. So the magnetic force to the metal disk 3 produced by the magnetic assembly 4 is reduced or eliminated, so that the rotational speed of the metal disk 3, the secondary transmission wheel 2, the primary transmission wheel 1 and the chain wheel 5 may maintain high. And then the resistance to the movement is reduced during the using of user.

Meanwhile, the magnetic assembly 4 may also be connected with a handle 9 (referring to FIG. 7) of the treadmill. The handle 9 may be controlled by a user according to one's own demand at any time during the using, so that the magnetic assembly 4 may be rotated close to a center of the metal disk 3, in order to increase the resistance to the movement and enhance the exercise intensity. The handle 9 may also be controlled by a user according to one's own fatigue condition in the exercise, so that the magnetic assembly 4 may be rotated away from the metal disk 3, in order to reduce the resistance to the movement and the exercise intensity.

According to the transmission system of the present application, the movement of transmission mechanism may be hindered through imposing the magnetic force to the metal disk, so that the resistance to the movement is changed to meet the user's demand for the different exercise intensity. And the required magnetic force provided as resistance by the magnetic assembly 4 is not great, but through multi-transmission of the secondary transmission wheel 2 and the primary transmission wheel 1, a dozen times resistance may be provided to hinder the rotation of the chain wheel 5, thereby achieving the effect of the intensive training of users.

As shown FIG. 1, in an embodiment, the primary transmission wheel 1 is connected with the chain wheel 5 coaxially through a first rotating shaft 12. A second rotating shaft 22 is provided on the secondary transmission wheel 2, and the secondary transmission wheel 2 is rotatably connected with the frame 8 through the second rotating shaft 22.

Further, the first belt 11 has a first end provided around an outer ring of the primary transmission wheel 1, and a second end provided around an outer ring of the second rotating shaft 22. The second rotating shaft 22 is rotated by the primary transmission wheel 1 through the first belt 11, so that the secondary transmission wheel 2 is driven to rotate. Because the diameter of the second rotating shaft 22 is small, the first belt 11 may be directly provided around the second rotating shaft 22 to increase the rotational speed of the second rotating shaft 22. Thus, the rotational speed of the secondary transmission wheel 2 coaxial with the second rotating shaft 22 is further increased.

Figure 6:
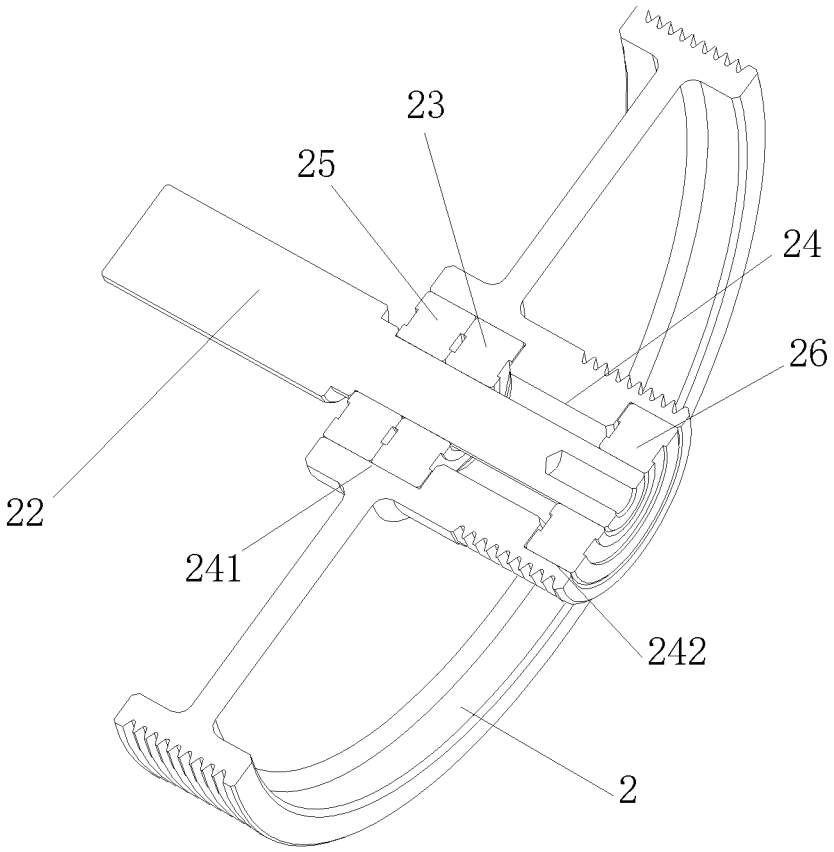
FIG. 6 is a schematic diagram of a secondary transmission wheel according to an embodiment of the present application.
Figure 7:
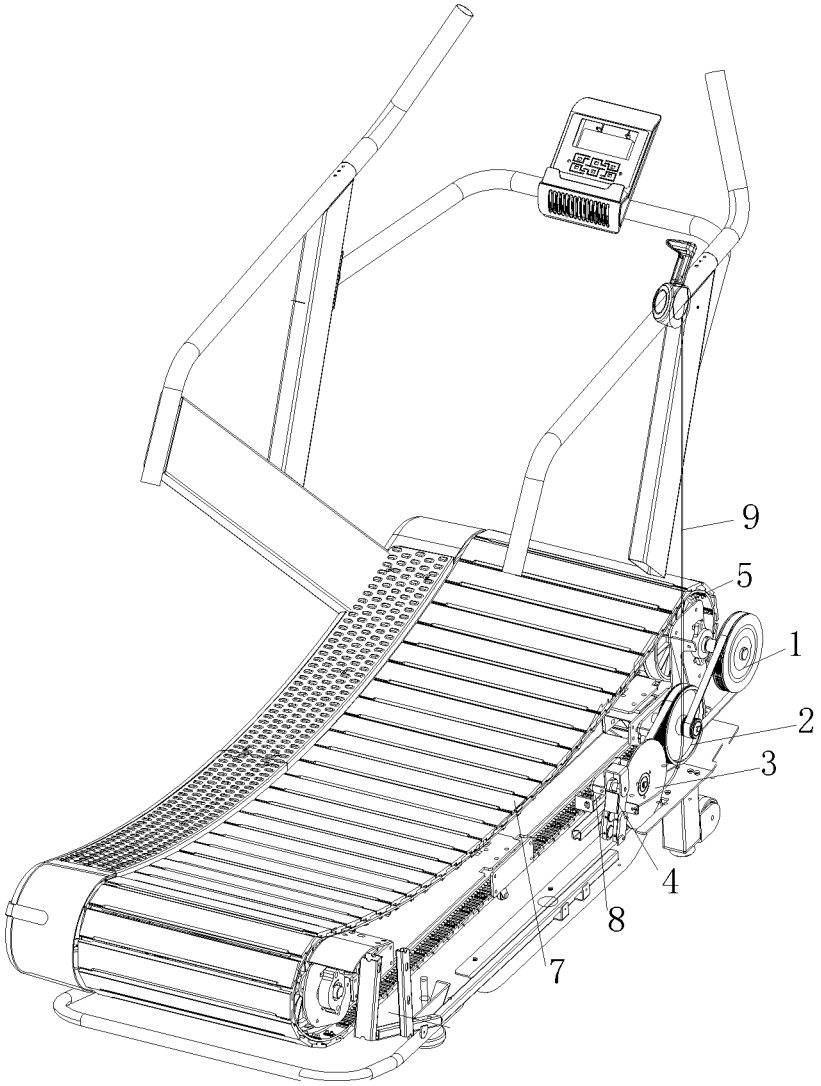
FIG. 7 is a schematic diagram of a treadmill according to an embodiment of the present application.

As shown FIG. 6, in an embodiment, the second rotating shaft 22 is connected with the secondary transmission wheel 2 through the one-way bearing 23. The second rotating shaft 22 may pass through the one-way bearing 23, and the one-way bearing 23 is fitted between the second rotating shaft 22 and the secondary transmission wheel 2.

Further, there is axle hole 24 being provided on the secondary transmission wheel 2, and the second rotating shaft 22 passes through the axle hole 24. The axle hole 24 has a first inner diameter. A first end of the axle hole 24 has a second inner diameter. The second inner diameter is larger than the first inner diameter. The first end of the axle hole 24 having the second inner diameter forms a first groove 241. The one-way bearing 23 is positioned into the first groove 421. The second rotating shaft 22 may pass through the one-way bearing 23 and the axle hole 24.

When the primary transmission wheel 1 rotates counterclockwise, the secondary transmission wheel 2 is driven to rotate counterclockwise by the first belt 11, whilst the secondary transmission wheel 2 may drive the metal disk 3 to rotate counterclockwise by the second belt 21. At the moment, the user may adjust the magnetic assembly 4 to rotate close to or away from a center of the metal disk 3, in order to provide a resistance to the transmission system.

When the primary transmission wheel 1 rotates clockwise, the first belt 11 may not drive the secondary transmission wheel 2 to rotate due to the one-way bearing 23 which is not capable of rotating clockwise. thus, the secondary transmission wheel 2 may not drive the metal disk 3 to rotate. As a result, when the primary transmission wheel 1 rotates clockwise, the transmission system keep still, in order to prevent the user from falling down.

In addition, a first deep groove ball bearing 25 is positioned in the first groove 241 and is adjacent to the one-way bearing 23. A second end, opposite to the first end, of the axle hole 24 has a third inner diameter. The third inner diameter is larger than the first inner diameter. The second end of the axle hole 24 having the third inner diameter forms a second groove 242. a second deep groove ball bearing 26 is positioned into the second groove 242. Therefore, the second rotating shaft 22 may pass through the first deep groove ball bearing 25, the one-way bearing 23, the axle hole 24 and the second deep groove ball 26 bearing.

As shown FIG. 2, in an embodiment, a third rotating shaft 32 is provided on the metal disk 3, and the metal disk 3 rotationally is connected with the frame 8 through the third rotating shaft 32.

Further, the second belt 21 has a first end provided around an outer ring of the secondary transmission wheel 2, and a second end provided around an outer ring of the third rotating shaft 32. The third rotating shaft 32 is driven to rotate by the secondary transmission wheel 2 through the second belt 21, so that the metal disk 3 is driven to rotate. Because the diameter of the third rotating shaft 32 is small, the second belt 21 may be directly provided around the third rotating shaft 32 to increase the rotational speed of the third rotating shaft 32. Thus, the rotational speed of the metal disk 3 coaxial with the third rotating shaft 32 is further increased.

Accordance with the transmission system of the present application, the first belt and the second belt are connected with the rotating shaft in order to transmit a force to the secondary transmission wheel and the metal disk. Therefore, the rotational speed of the metal disk may be further increased with the condition of the same input rotational speed of the chain wheel. Contrarily, when the resistance is applied to the metal disk by the magnetic assembly, the rotational speed of the metal disk may be reduced therewith, and a great brake action may be produced by the reduced movement transmitting to the chain wheel and the track through the secondary transmission wheel and the primary transmission wheel. The required magnetic force as resistance provided by the magnetic assembly 4 is not great, but through multilevel transmission of the secondary transmission wheel 2 and the primary transmission wheel 1, a dozen times resistance may be provided to prevent the rotation of the chain wheel 5, thereby achieving the effect of the intensive training for users.

As shown in the FIGS. 1 and 2, in an embodiment, the frame 8 is provided with a connector 8, and the magnetic assembly 4 is rotationally connected with the connector 8. Through providing with independent a connector 8 to connect the magnetic assembly 4, the interference between the magnetic assembly 4 and other parts on the frame 8 could be avoided, when the magnetic assembly 4 is directly connected to the frame 8.

Figure 5:
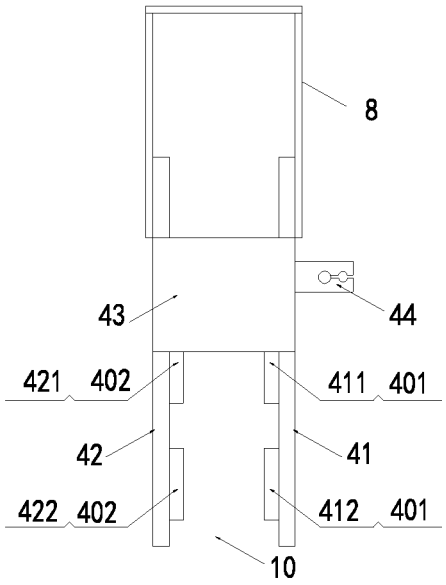
FIG. 5 is a side view of a magnetic assembly according to an embodiment of the present application.

As shown in the FIG. 5, in an embodiment, the magnetic assembly 4 includes a first connecting arm 41 and a second connecting arm 42 opposite to the first connecting arm 41. The first connecting arm 41 and the second connecting arm 42 may be both pivoted to the connector 8 and movably close to or away from a center of the metal disk 3.

Further, a gap 10 is provided between the first connecting arm 41 and the second connecting arm 42. The metal disk 3 passes through the gap 10. And a first magnetic component 401 is provided on a side, opposite to the second connecting arm 42, of the first connecting arm 41, and a second magnetic component 402 is provided on a side, opposite to the first connecting arm 41, of the second connecting arm 42.

The magnetic component may include an integral magnetic element, and may also include a plurality of independent magnetic elements.

A magnetic field may be produced between the first magnetic component 401 and the second magnetic component 402. When the magnetic assembly 4 is rotated close to a center of the metal disk 3, the metal disk 3 may pass through the gap 10 between the first connecting arm 41 and the second connecting arm 42. And as the metal disk 3 is rotated, a cutting magnetic motion is performed, so that the magnetic field may produce resistance to the rotation of the metal disk 3.

As shown in the FIG. 5, in an embodiment, the first magnetic component 401 includes a first magnetic element 411 and a second magnetic element 412, and the second magnetic component 402 includes a third magnetic element 421 and a fourth magnetic element 422. Multiple magnetic elements are provided to increase the effect of magnetic field produced by the magnetic assembly 4. Accordingly, when the metal disk 3 (shown in FIG. 1) passes through the gap 10, a stronger resistance may be imposed on the metal disk 3.

Preferably, the first magnetic element 411 is disposed opposite to the third magnetic element 421, and the second magnetic element 412 is disposed opposite to the fourth magnetic element 422.

The magnetic fields produced by the first magnetic element 411 and the third magnetic element 421 may be superimposed on each other, and the magnetic fields produced by the second magnetic element 412 and the fourth magnetic element 422 may also be superimposed on each other, thereby enhancing the magnetic field intensity overall. Accordingly, when the metal disk 3 (shown in FIG. 1) passes through the gap 10, a stronger resistance may be imposed on the metal disk 3, and the user's exercise intensity may be increased to a greater extent.

As shown in the FIGS. 1 and 5, in an embodiment, the first connecting arm 41 is connected to the second connecting arm 42 through a connecting board 43 to guarantee the first connecting arm 41 and the second connecting arm 42 to rotate stably.

Further, a fixing part 44 is provided on the first connecting arm 41. The rope (not shown) may be fixed on the fixing part 44 and connected to the handle 9 of the treadmill. A user may manipulate the handle to cause the linkage between the rope and the first connecting arm 41 to drive the magnetic assembly 4 to rotate close to or away from a center of the metal disk 3.

A second aspect of the present application provides a treadmill.

The treadmill of the present application includes the transmission system as the above described. The other configurations of the treadmill of the present embodiment can apply with various technical solutions in the prior art and in the future, which are known to those skilled, and will not be described in detail herein.

It should be noted that the "front", "rear", "upper", "lower" and the like described herein are intended for the convenience of description, and do not necessarily correspond to the space in actual work.

In the description of the present specification, the description of the terms "one embodiment", "some embodiments", "example", "specific example", or "some examples" and the like means that the particular features, structures, materials or characteristics described in combination of the embodiments or examples are included in at least one embodiment or example of the present application. Furthermore, the particular features, structures, materials, or characteristics described may be combined in a proper manner in any one or more embodiments or examples. In addition, in the absence of contradiction, various embodiments or examples described in the specification, as well as features of various embodiments or examples, may be combined and integrated.

In addition, the terms "first" and "second" are merely for illustrative purposes and are not to be construed as indicating or implying a relative importance or implicitly indicating the number of technical features indicated. Thus, the features defining "first" or "second" may expressly or implicitly include at least one feature. In the description of the present application, the meaning of "a plurality of" refers to two or more, unless otherwise specifically defined.

The foregoing are merely specific embodiments of the present application, but the scope of the present application is not to be limited thereto. The person skilled in the art can easily conceive various alternations or replacements within the scope of the present application as disclosed, and these alternations or replacements should be covered within the protection scope of the present application. Accordingly, the protection scope of the present application should be based on the protection scope of the claims.

What is claimed is:

1. A transmission system for a treadmill, comprising: a primary transmission wheel, a secondary transmission wheel, a metal disk and a magnetic assembly; wherein:

the primary transmission wheel is rotated coaxially with a chain wheel of the treadmill;

the secondary transmission wheel is connected with the primary transmission wheel through a first belt;

the metal disk is connected with the secondary transmission wheel through a second belt;

the magnetic assembly is rotatably connected to a frame of the treadmill, and the magnetic assembly is movable close to or away from a center of the metal disk, to provide a resistance to the metal disk; and the magnetic assembly is connected with a handle of the treadmill, the handle is configured to control the magnetic assembly to rotate relative to the frame;

the primary transmission wheel is coaxially connected with the chain wheel of the treadmill through a first rotating shaft;

a second rotating shaft is provided on the secondary transmission wheel, and the secondary transmission wheel is rotatably connected with the frame through the second rotating shaft;

the first belt has a first portion provided around an outer ring of the primary transmission wheel, and a second portion provided around an outer ring of the second rotating shaft;

the second rotating shaft is connected with the secondary transmission wheel through a one-way bearing;

the secondary transmission wheel is provided with an axle hole, the second rotating shaft passes through the axle hole, the axle hole has a first inner diameter and a first end of the axle hole has a second inner diameter, the second inner diameter is larger than the first inner diameter, the first end of the axle hole having the second inner diameter forms a first groove, and the one-way bearing is positioned into the first groove; and the second rotating shaft is provided passing through the one-way bearing and the axle hole.

2. The transmission system for the treadmill according to claim 1, wherein a first deep groove ball bearing is positioned in the first groove and is adjacent to the one-way bearing, a second end, opposite to the first end, of the axle hole has a third inner diameter, the third inner diameter is larger than the first inner diameter, the second end of the axle hole having the third inner diameter forms a second groove, and a second deep groove ball bearing is positioned into the second groove; and the second rotating shaft is provided passing through the first deep groove ball bearing, the one-way bearing, the axle hole and the second deep groove ball bearing.

3. A treadmill, comprising the transmission system for the treadmill according to claim 2.

4. The transmission system for the treadmill according to claim 1, wherein a third rotating shaft is provided on the metal disk, and the metal disk is rotatably connected with the frame through the third rotating shaft; and the second belt has a first portion provided around an outer ring of the secondary transmission wheel, and a second portion provided around an outer ring of the third rotating shaft.

5. A treadmill, comprising the transmission system for the treadmill according to claim 4.

6. The transmission system for the treadmill according to claim 1, wherein a connector is provided at the frame, and the magnetic assembly is rotatably connected with the connector.

7. The transmission system for the treadmill according to claim 6, wherein the magnetic assembly comprises a first connecting arm, and a second connecting arm opposite to the first connecting arm; and the first connecting arm and the second connecting arm are both pivoted to the connector;

a gap is provided between the first connecting arm and the second connecting arm and the metal disk passes through the gap; and a first magnetic component is provided on the first connecting arm, a second magnetic component is provided on the second connecting arm.

8. The transmission system for the treadmill according to claim 7, wherein the first magnetic component is provided on a side, opposite to the second connecting arm, of the first connecting arm; and the second magnetic component is provided on a side, opposite to the first connecting arm, of the second connecting arm.

9. The transmission system for the treadmill according to claim 8, wherein the first magnetic component comprises a first magnetic element and a second magnetic element, the second magnetic component comprises a third magnetic element and a fourth magnetic element.

10. The transmission system for the treadmill according to claim 9, wherein the first magnetic element is disposed opposite to the third magnetic element, and the second magnetic element is disposed opposite to the fourth magnetic element.

11. The transmission system for the treadmill according to claim 10, wherein the first connecting arm is connected to the second connecting arm through a connecting board;

a fixing part is provided on the first connecting arm and/or the second connecting arm, and the fixing part is fixed to a rope connected to the handle; and the handle is configured to control the magnetic assembly to rotate relative to the frame.

12. A treadmill, comprising the transmission system for the treadmill according to claim 6.

13. A treadmill, comprising the transmission system for the treadmill according to claim 7.

14. A treadmill, comprising the transmission system for the treadmill according to claim 1.

* * * * *